US011773869B2

(12) United States Patent
Ravindranath et al.

(10) Patent No.: US 11,773,869 B2
(45) Date of Patent: Oct. 3, 2023

(54) SYSTEMS FOR A PUMP SEAL CHAMBER

(71) Applicant: Transportation IP Holdings, LLC, Norwalk, CT (US)

(72) Inventors: Balaji Hosadurgam Ravindranath, Mysore (IN); Neil Blythe, Erie, PA (US); Charles Atz, New Castle, PA (US)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 94 days.

(21) Appl. No.: 17/151,592

(22) Filed: Jan. 18, 2021

(65) Prior Publication Data

US 2022/0065262 A1 Mar. 3, 2022

Related U.S. Application Data

(60) Provisional application No. 63/069,977, filed on Aug. 25, 2020.

(51) Int. Cl.
*F04D 29/42* (2006.01)
*F04D 29/70* (2006.01)

(52) U.S. Cl.
CPC ..... *F04D 29/426* (2013.01); *F04D 29/708* (2013.01)

(58) Field of Classification Search
CPC ..... F04D 29/426; F04D 29/708
USPC ..... 415/1
See application file for complete search history.

(56) References Cited

U.S. PATENT DOCUMENTS 3,484,113 A * 12/1969 Moore ..... F04D 29/128 277/408
3,999,882 A * 12/1976 Purton ..... F01D 11/06 415/112
4,128,362 A * 12/1978 Shepherd ..... F04D 29/126 415/176
4,501,530 A * 2/1985 Rockwood ..... F04D 29/622 415/230
5,195,867 A * 3/1993 Stirling ..... F04D 29/128 415/111
5,372,730 A * 12/1994 Warner ..... F16J 15/3404 210/791
5,713,719 A * 2/1998 Fiore ..... F04D 29/426 415/113
5,772,396 A * 6/1998 Rockwood ..... F04D 29/128 415/113
6,099,243 A * 8/2000 Fiore ..... F04D 29/128 415/206
7,008,177 B2 * 3/2006 Britt ..... F01D 1/02 415/231

(Continued)

*Primary Examiner* — Hung Q Nguyen
*Assistant Examiner* — Anthony Donald Taylor, Jr.
(74) *Attorney, Agent, or Firm* — McCoy Russell LLP

(57) ABSTRACT

Various systems are provided for a seal chamber of a centrifugal pump. In one example, a seal chamber housing for a centrifugal pump includes a central cavity internal to the seal chamber housing, the central cavity having a greater diameter at a first end of the seal chamber housing and a smaller diameter at a second end of the seal chamber housing, and at least one flushing passage at the second end of the seal chamber housing. The at least one flushing passage is configured to directly fluidically couple the central cavity to an exterior of the seal chamber housing. In this way, increased cooling and debris removal may be provided to a seal positioned within the seal chamber housing.

20 Claims, 10 Drawing Sheets

(56) References Cited

U.S. PATENT DOCUMENTS

| | | | | |
|---|---|---|---|---|
| 7,112,033 | B1 * | 9/2006 | Holdorf | F04D 29/128<br>415/113 |
| 2004/0156711 | A1 * | 8/2004 | Quinn | F16J 15/3404<br>415/170.1 |

* cited by examiner

SYSTEMS FOR A PUMP SEAL CHAMBER

CROSS-REFERENCE TO RELATED APPLICATIONS

This application claims priority to U.S. Provisional Application No. 63/069,977 filed 25 Aug. 2020, hereby incorporated by reference herein.

BACKGROUND

Technical Field

Embodiments of the subject matter disclosed herein relate to a centrifugal pump.

Discussion of Art

Efficient circulation of a coolant through an engine system may mitigate overheating and resulting degradation of engine components that may interrupt engine operation and shorten a lifetime of the components. By flowing the coolant through channels or compartments of a cooling system in contact with the components, heat may be transferred from the engine system to the coolant. The coolant flow may be driven by a pump that may be mechanically operated by an engine crankshaft or another rotating component, such as a motor or any other prime mover. In some examples, the pump may be a centrifugal pump that includes a shaft-driven impeller within a pump chamber to drive fluid motion.

The pump may be configured with a mechanical seal that provides an interface between the shaft and a housing of the pump (e.g., the pump housing or scroll) to block coolant from leaking out of the pump housing. The seal may be disposed within a seal cavity and may include a stationary ring that fits into the pump housing with a central opening that allows the impeller shaft to pass through. The seal may further include a rotating ring affixed to the shaft that spins at a same rotational velocity as the pump. The rotating ring may seat against the stationary seal, preventing coolant leakage via mating surfaces. Pumped coolant may enter the seal cavity and circulate around the seal. Further, a thin layer of coolant may form between the rotating ring and the stationary ring to lubricate the mating surfaces and reduce the heat-generated due to the friction.

However, the seal may be positioned in a region of reduced fluid motion, and thus, reduced cooling may occur at the seal. As a result, the seal may be subjected to high temperatures that may cause deterioration of the seal materials. Continued exposure to heat may lead to coolant leakage and seizing of the pump. Further, because of the reduced fluid motion at the seal, debris in the coolant may gather at the seal and degrade or deposit on the mating surfaces, resulting in coolant leakage past the seal. As a result of the coolant leakage or seizing of the pump, the pump may be repaired or replaced, leading to engine system downtime and increased repair costs.

BRIEF DESCRIPTION

In one embodiment, a seal chamber housing for a centrifugal pump includes a central cavity internal to the seal chamber housing. The central cavity has a greater diameter at a first end of the seal chamber housing and a smaller diameter at a second end of the seal chamber housing. The seal chamber housing also includes at least one flushing passage at the second end of the seal chamber housing. The at least one flushing passage is configured to directly fluidically couple the central cavity to an exterior of the seal chamber housing.

BRIEF DESCRIPTION OF THE DRAWINGS

The present disclosure will be better understood from reading the following description of non-limiting embodiments, with reference to the attached drawings, wherein below.

DETAILED DESCRIPTION

The following description relates to embodiments of a seal chamber housing for a centrifugal pump, including a central cavity internal to the seal chamber housing, the central cavity having a greater diameter at a first end of the seal chamber housing and a smaller diameter at a second end of the seal chamber housing, and at least one flushing passage at the second end of the seal chamber housing, the at least one flushing passage configured to directly fluidically couple the central cavity to an exterior of the seal chamber housing. For example, the central cavity may be defined by an inner surface of the seal chamber housing, and the inner surface may include a constant diameter region proximate to the second end of the seal chamber housing and a variable diameter region extending between the constant diameter region and the first end of the seal chamber housing. A length of the constant diameter region may be smaller than a length of the variable diameter region, and a diameter of the variable diameter region may increase toward the first end of the seal chamber housing. As another example, the at least one flushing passage may form a channel in a back exterior surface of the seal chamber at the second end and may have an inlet at the constant diameter region. The at least one flushing passage may be arranged at a tangent from the constant diameter region or helically around the constant diameter region, for example. In some examples, the at least one flushing passage may include a volute, a chamber, and/or a diffuser.

Further, when the seal chamber housing is installed in the centrifugal pump, the seal chamber housing may at least partially define a coolant-filled seal chamber within a pump casing (e.g., housing). The seal chamber may house a seal interface formed between a stationary seal and a rotating seal, the seal interface configured to prevent the coolant from flowing out of the pump casing. In particular, the seals may be positioned proximate to the second end of the seal chamber housing. By including the inlet to the at least one flushing passage at the smaller diameter end of the seal chamber housing and proximate to the seal interface, a velocity of coolant at the smaller diameter region may be increased (versus locating the inlet at another location or not including the at least one flushing passages). As a result, an amount of debris removed from the seal interface may be increased. Further, by increasing the coolant motion at the seal interface, increased cooling may be provided to the seals. In this way, both debris-related and heat-related seal degradation may be decreased, thereby reducing coolant leakage and centrifugal pump degradation. Overall, repair costs and downtime of the centrifugal pump may be decreased.

Figure 1:
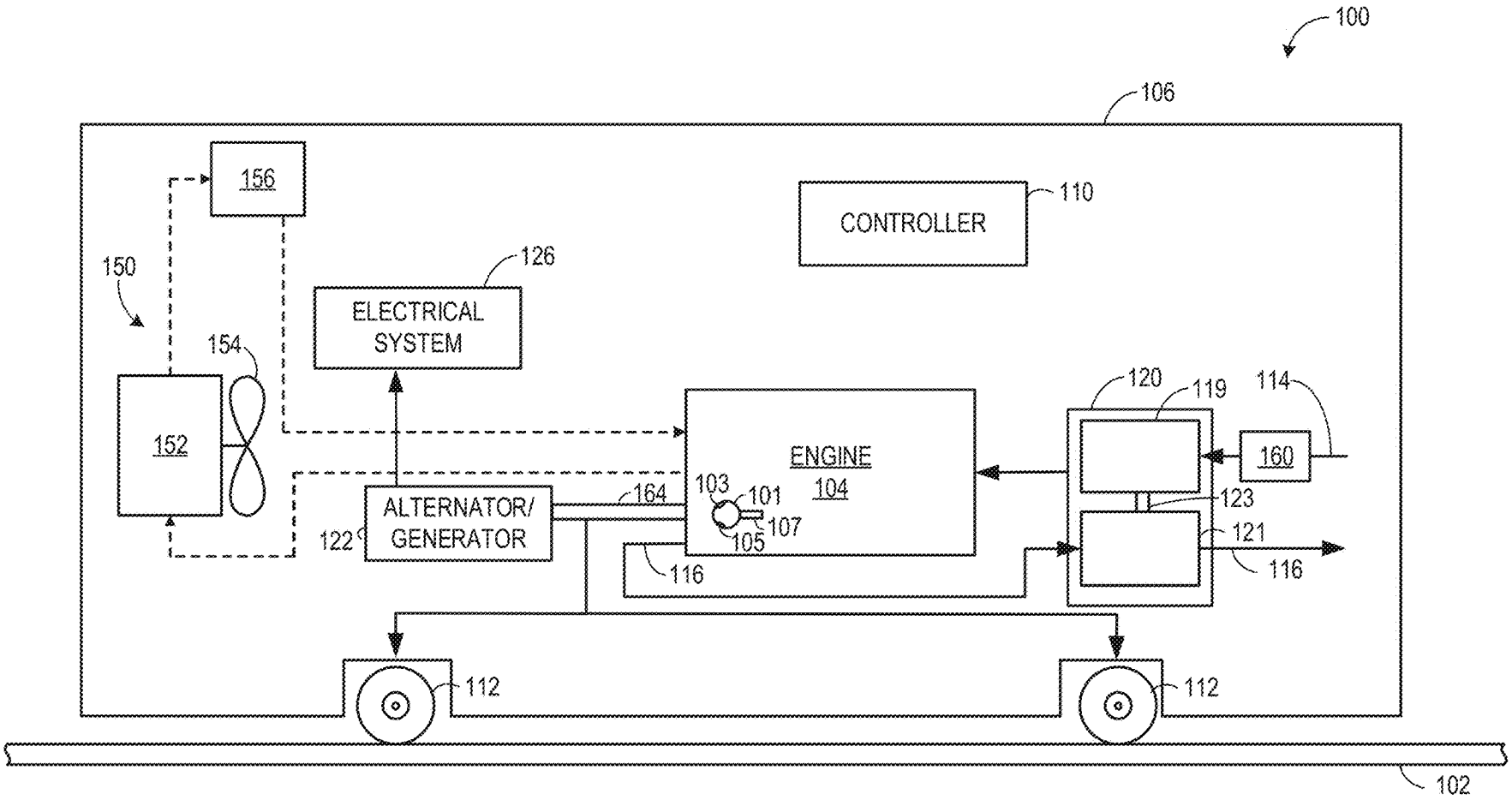
FIG. 1 shows a schematic diagram of a vehicle with an engine.
Figure 2:
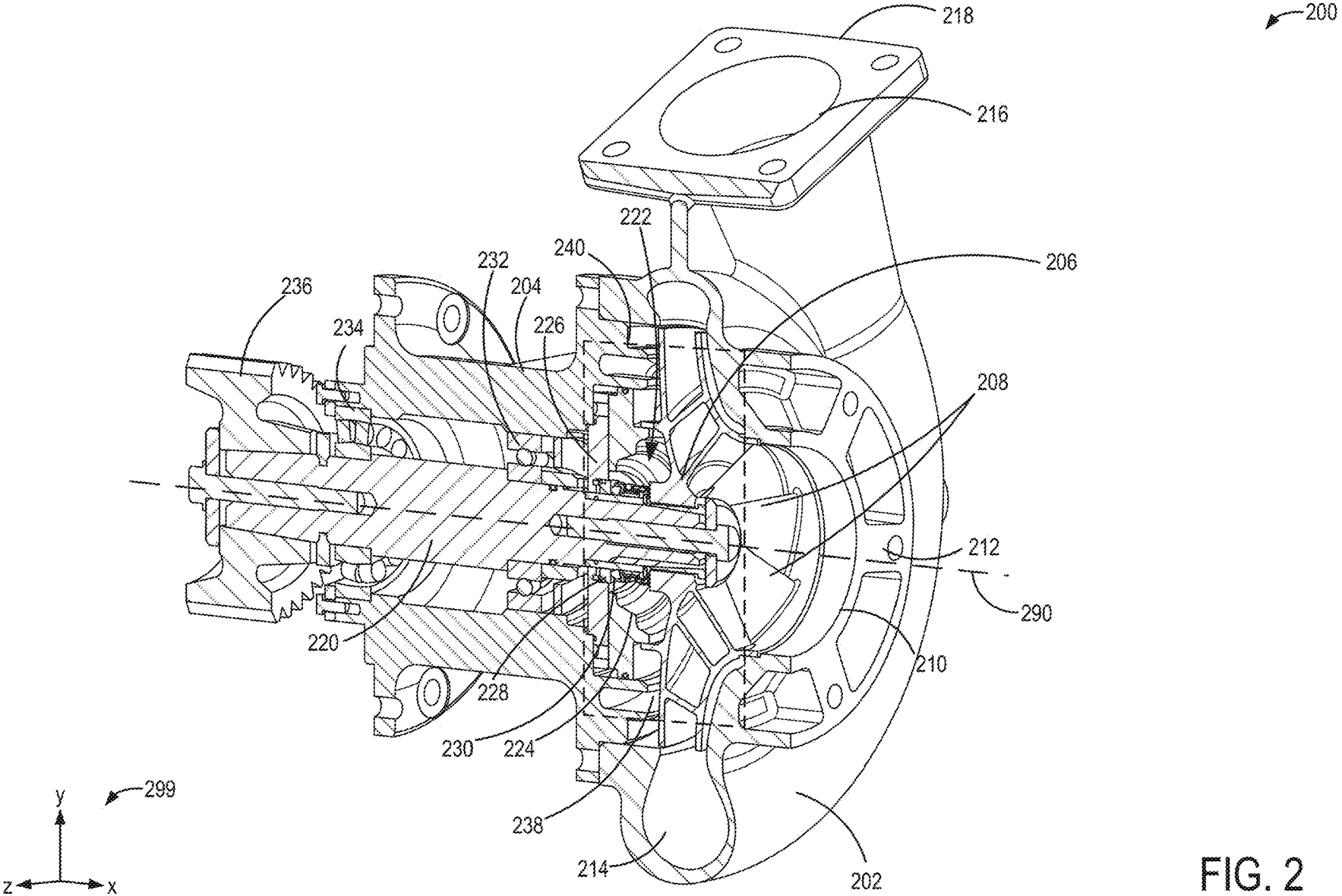
FIG. 2 shows an embodiment of a centrifugal pump that may be included in an engine cooling system.
Figure 5:
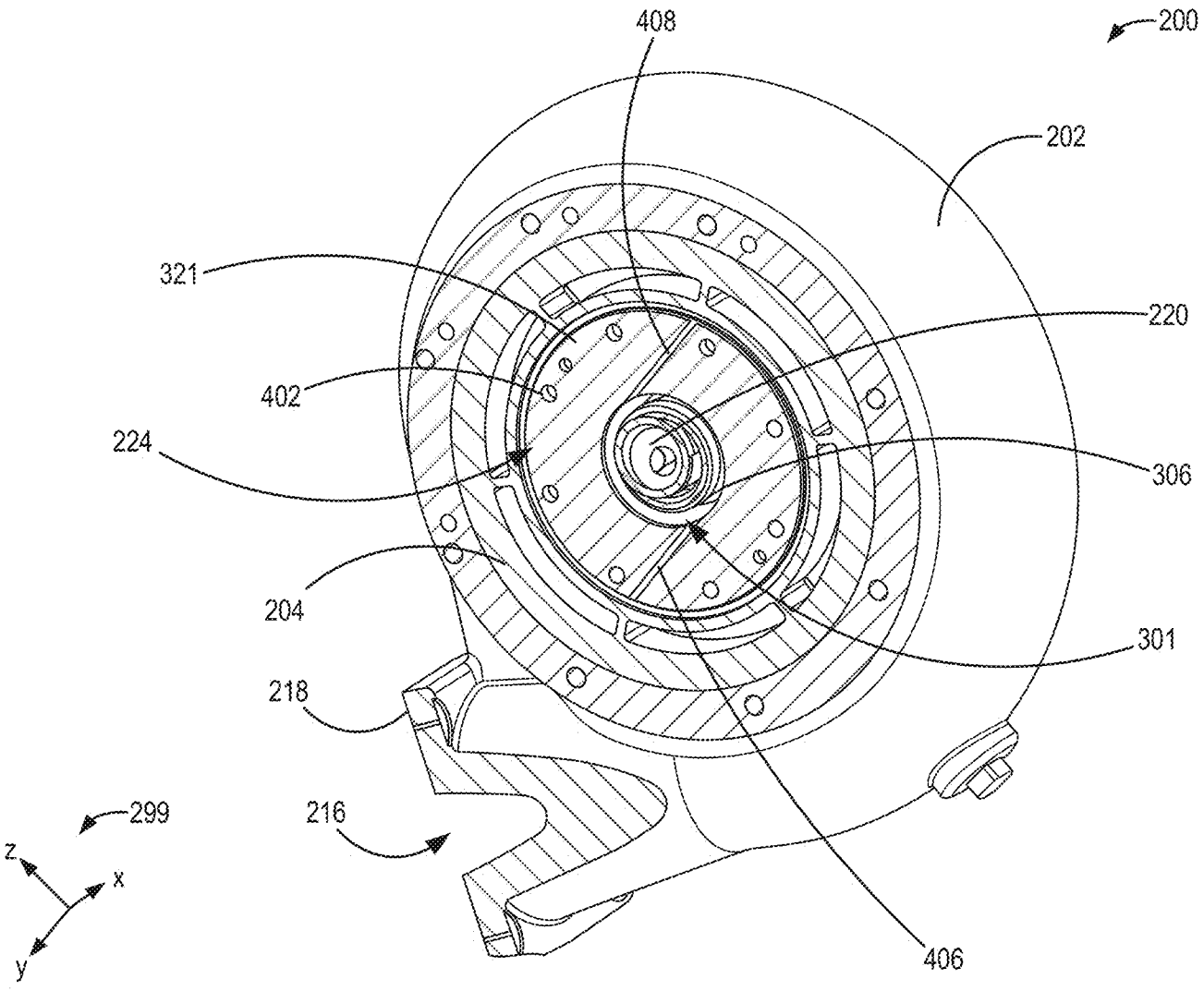
FIG. 5 shows a back view of the seal chamber housing of FIGS. 4A-4C while installed in the centrifugal pump of FIG. 2.
Figure 6:
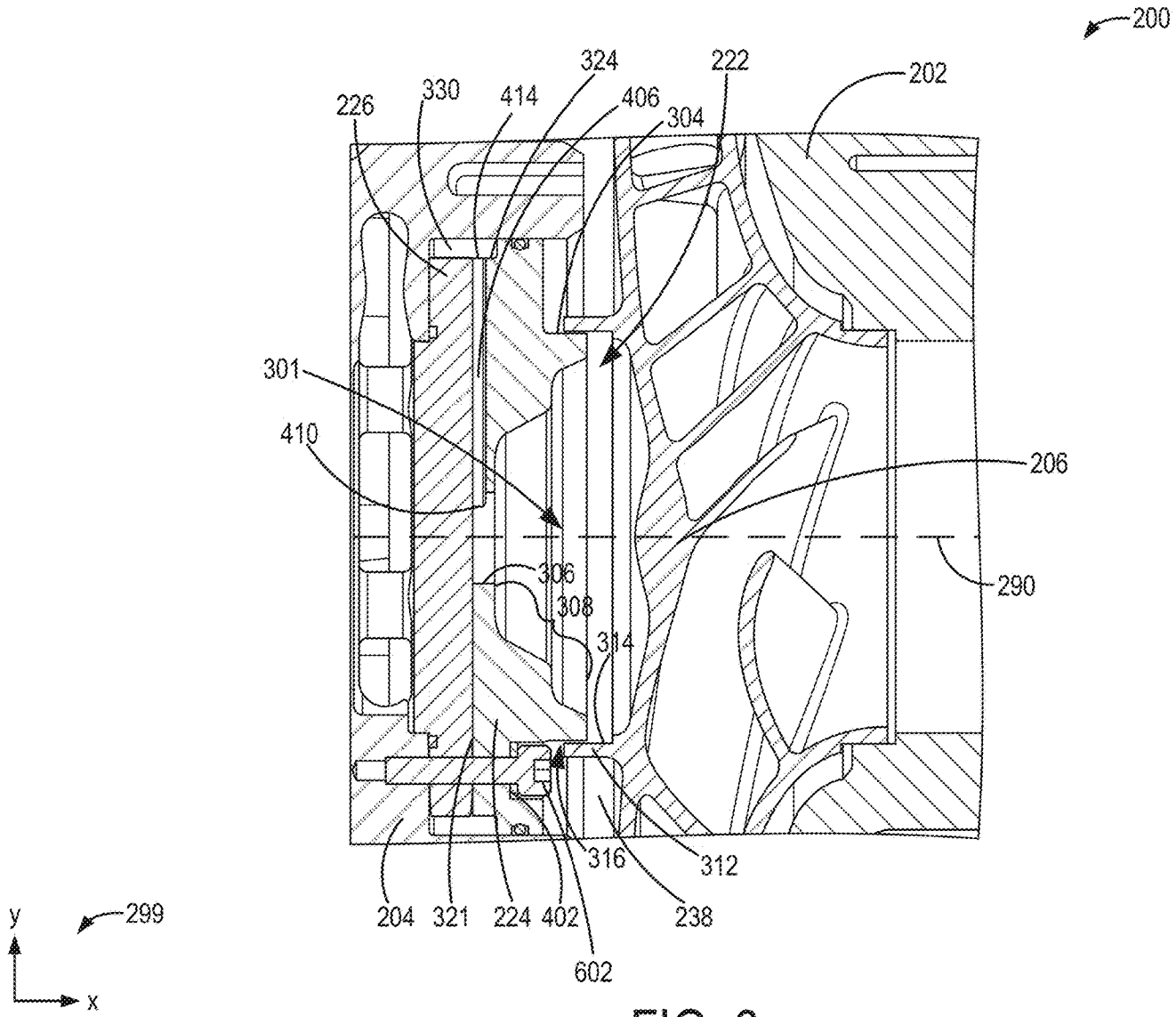
FIG. 6 shows a cross-sectional view of the seal chamber housing of FIG. 4A-4C in the centrifugal pump of FIG. 2.
Figure 7:
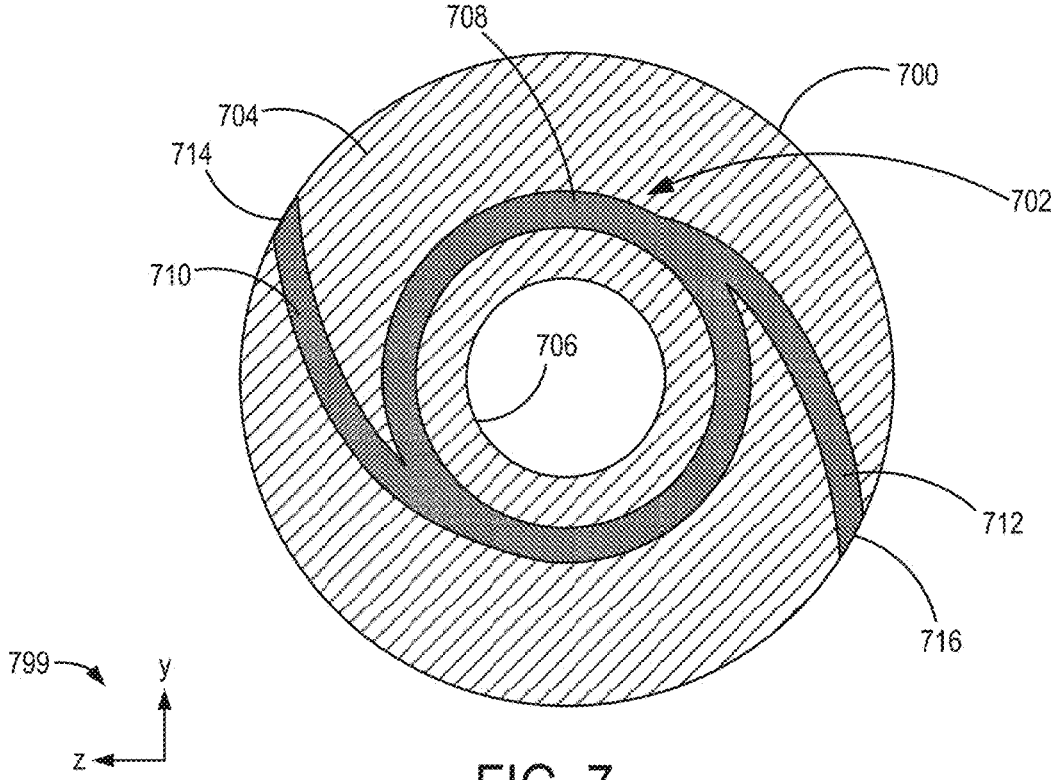
FIG. 7 schematically shows a second embodiment of the seal chamber housing, the second embodiment including helical flushing ports.
Figure 8:
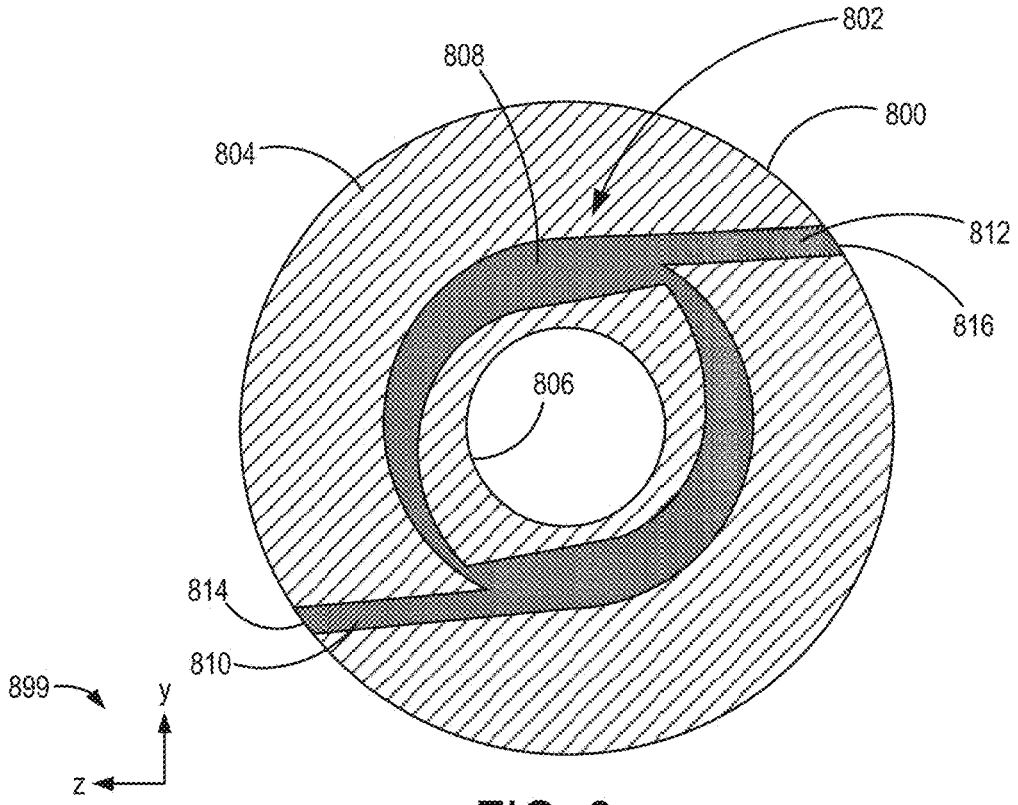
FIG. 8 schematically shows a third embodiment of the seal chamber housing, the third embodiment including a volute-shaped region in a flushing passage.
Figure 9:
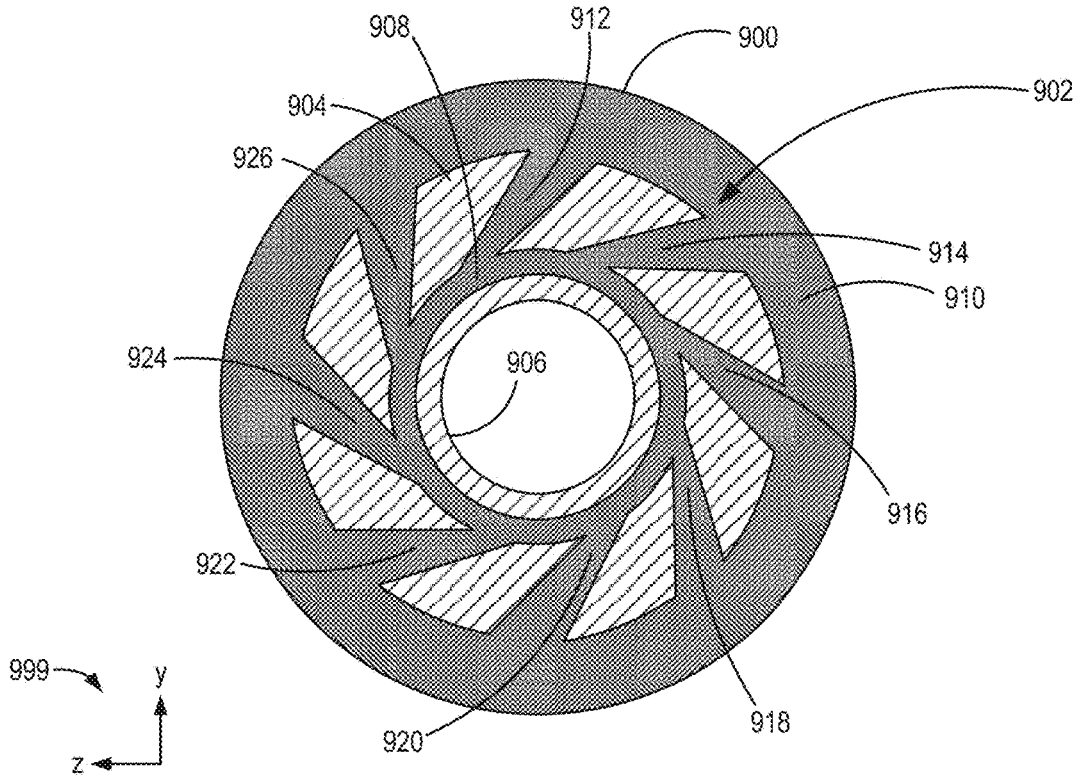
FIG. 9 schematically shows a fourth embodiment of the seal chamber housing, the fourth embodiment including a diffuser in a flushing passage.
Figure 10:
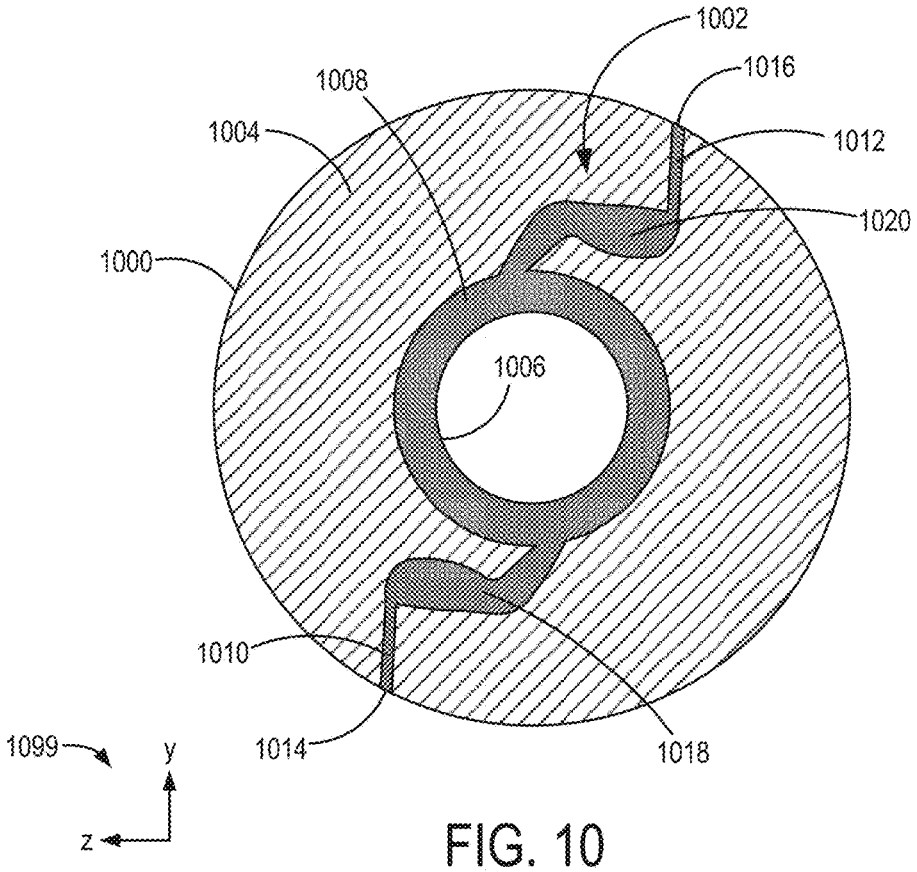
FIG. 10 schematically shows a fifth embodiment of the seal chamber housing, the fifth embodiment including a dead chamber in a flushing passage.
Figure 11:
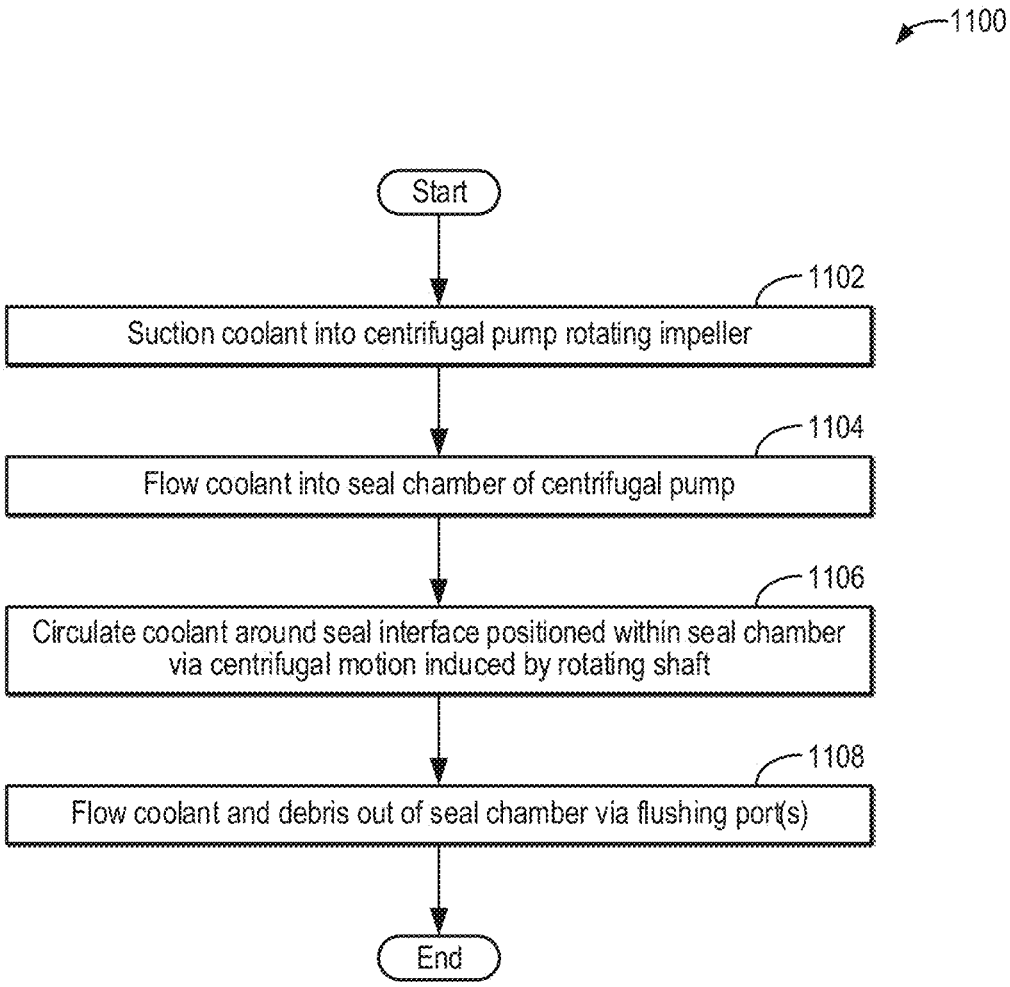
FIG. 11 shows a flowchart of an example method for flowing coolant through the centrifugal pump of FIG. 2.

FIG. 1 shows an example of a vehicle engine system that includes an engine cooling system. The engine cooling system may include a centrifugal pump, a cross-sectional view of which is shown in FIG. 2. The centrifugal pump may include a seal chamber, shown in FIG. 3, that is shaped to induce increased centrifugal motion for increased cooling and debris removal at a seal interface positioned within the seal chamber. The seal chamber includes a seal chamber housing, a first embodiment of which is shown in an isolated view in FIGS. 4A-4C. Specifically, the first embodiment of the seal chamber housing includes a truncated stepped conical-shaped interior and tangentially located flushing ports. The tangentially located flushing ports include channels within a back surface of the seal chamber housing, as shown in FIG. 5. A cross-sectional view of the seal chamber housing in the centrifugal pump that highlights the tangentially located flushing ports is shown in FIG. 6. FIGS. 7-10 schematically show alternative embodiments of the seal chamber housing. Specifically, FIG. 7 shows a second embodiment of the seal chamber housing that includes helical flushing ports, FIG. 8 shows a third embodiment of the seal chamber housing that includes a volute shape within the flushing ports, FIG. 9 shows a fourth embodiment of the seal chamber housing that includes a diffuser, and FIG. 10 shows a fifth embodiment of the seal chamber housing that includes dead chambers within the flushing ports. Further, FIG. 11 shows an example method for circulating coolant through the centrifugal pump, including around the seal chamber and out of the flushing ports.

The approach described herein may be employed in a variety of engine types and a variety of engine-driven systems. Some of these systems may be stationary, while others may be on semi-mobile or mobile platforms. Semi-mobile platforms may be relocated between operational periods, such as mounted on flatbed trailers. Mobile platforms include self-propelled vehicles. Such vehicles can include on-road transportation vehicles, as well as mining equipment, marine vessels, rail vehicles, and other off-highway vehicles (OHV). For clarity of illustration, an automobile is provided as an example of a mobile platform supporting a system incorporating an embodiment of the invention.

Referring to FIG. 1, an embodiment of a system in which a centrifugal pump may be installed is shown. Specifically, FIG. 1 shows a block diagram of an embodiment of a vehicle system 100, herein depicted as a motor vehicle 106 (e.g., automobile), configured to run on a road 102 via a plurality of wheels 112. As depicted, the motor vehicle 106 includes an engine 104. The engine includes a plurality of cylinders 101 (only one representative cylinder shown in FIG. 1) that each include at least one intake valve 103, at least one exhaust valve 105, and at least one fuel injector 107. Each intake valve, exhaust valve, and fuel injector may include an actuator that may be actuated via a signal from a controller 110 of the engine 104. In other non-limiting embodiments, the engine 104 may be a stationary engine, such as in a power-plant application, or an engine in a marine vessel or other off-highway vehicle propulsion system as noted above.

The engine 104 receives intake air for combustion from an intake passage 114. The intake passage 114 includes an air filter 160 that filters air from outside of the motor vehicle. Exhaust gas resulting from combustion in the engine is supplied to an exhaust passage 116. Exhaust gas flows through the exhaust passage 116 and out of an exhaust system of the motor vehicle. Combustion in the cylinder drives rotation of a crankshaft 164. In one example, the engine is a diesel engine that combusts air and diesel fuel through compression ignition. In another example, the engine is a dual or multi-fuel engine that may combust a mixture of gaseous fuel and air upon injection of diesel fuel during compression of the air-gaseous fuel mix. In other non-limiting embodiments, the engine may additionally or alternatively combust fuel including gasoline, kerosene, natural gas, biodiesel, or other petroleum distillates of similar density through compression ignition and/or spark ignition.

As depicted in FIG. 1, the engine is coupled to an electric power generation system that includes an alternator/generator 122. For example, the engine is a diesel and/or natural gas engine that generates a torque output that is transmitted to the alternator/generator 122, which is mechanically coupled to the crankshaft 164, as well as to at least one of the plurality of wheels 112 to provide motive power to propel the motor vehicle. The alternator/generator 122 produces electrical power that may be stored and applied for subsequent propagation to a variety of downstream electrical components. In one example, the alternator/generator 122 may be coupled to an electrical system 126. The electrical system 126 may include one or more electrical loads configured to run on electricity generated by the alternator/generator 122, such as vehicle headlights, a cabin ventilation system, and an entertainment system, and may further include an energy storage device (e.g., a battery) configured to be charged by electricity generated by the alternator/generator 122. In some examples, the vehicle may be a diesel electric vehicle, and the alternator/generator 122 may provide electricity to one or more electric motors to drive the wheels 112.

The vehicle system may include a turbocharger 120 that is arranged between the intake passage and the exhaust passage. The turbocharger 120 increases an air charge of ambient air drawn into the intake passage in order to provide greater charge density during combustion to increase power output and/or engine operating efficiency. The turbocharger 120 may include at least one compressor 119, which is at least partially driven by at least one corresponding turbine 121 via a turbocharger shaft 123.

In some embodiments, the vehicle system may further include an aftertreatment system coupled in the exhaust passage upstream and/or downstream of the turbocharger 120. In one embodiment, the aftertreatment system may include one or more emission control devices. Such emission control devices may include a selective catalytic reduction (SCR) catalyst, a three-way catalyst, a $NO_x$ trap, or various other devices or exhaust aftertreatment systems. In another embodiment, the aftertreatment system may additionally or alternatively include a diesel oxidation catalyst (DOC) and a diesel particulate filter (DPF).

As depicted in FIG. 1, the vehicle system further includes a cooling system 150 (e.g., an engine cooling system). The cooling system 150 circulates coolant through the engine 104 to absorb waste engine heat and distribute the heated coolant to a heat exchanger, such as a radiator 152 (e.g., a radiator heat exchanger). As an example, the coolant may be water, water with additives, antifreeze, or a mixture of water and antifreeze. A fan 154 may be coupled to the radiator 152 in order to maintain an airflow through the radiator 152 when the vehicle is moving slowly or stopped while the engine 104 is running. In some examples, fan speed may be controlled by the controller 110. Coolant that is cooled by the radiator 152 may enter a tank (not shown). The coolant may then be pumped by a water pump 156 back to the engine or to another component of the vehicle system. The water pump 156 may be a centrifugal pump that is mechanically coupled to the engine 104 so that rotation of crankshaft 164 drives the water pump 156. Alternatively, the water pump 156 may be driven by an electric motor that receives power generated by the alternator/generator 122. Coolant may be pumped via a series of water lines, with one or more water lines fluidically coupling the radiator to the pump, one or more water lines fluidically coupling the water pump 156 to the engine 104, and one or more water lines fluidically coupling the engine 104 to the radiator 152. In some examples, the water lines may be fabricated from a flexible material, such as polyurethane or rubber, for example. In other examples, the water lines may be fabricated from an inflexible material, such as copper or steel.

The controller 110 may be configured to control various components related to the motor vehicle. As an example, various components of the vehicle system may be coupled to the controller 110 via a communication channel or data bus. In one example, the controller 110 includes a computer control system. The controller 110 may additionally or alternatively include a memory holding non-transitory computer readable storage media (not shown) including code for enabling on-board monitoring and control of motor vehicle operation. In some examples, the controller 110 may include more than one controller each in communication with one another, such as a first controller to control the engine and a second controller to control other operating parameters of the vehicle (such as engine load, engine speed, brake torque, etc.). The first controller may be configured to control various actuators based on output received from the second controller and/or the second controller may be configured to control various actuators based on output received from the first controller.

The controller 110 may receive information from a plurality of sensors and may send control signals to a plurality of actuators. The controller 110, while overseeing control and management of the engine and/or vehicle, may be configured to receive signals from a variety of engine sensors, as further elaborated herein, in order to determine operating parameters and operating conditions, and correspondingly adjust various engine actuators to control operation of the engine and/or vehicle. For example, the controller 110 may receive signals from various engine sensors including, but not limited to, measurements of engine speed, engine load, intake manifold air pressure, boost pressure, exhaust pressure, ambient pressure, ambient temperature, equivalence ratio, engine temperature, particulate filter temperature, particulate filter back pressure, engine coolant pressure, or the like. Additional sensors, such as coolant temperature sensors, may be positioned in the cooling system. Correspondingly, the controller 110 may control the engine and/or the vehicle by sending commands to various components such as the alternator/generator 122, fuel injectors 107, valves, water pump 156, or the like. For example, the controller 110 may control the operation of a restrictive element (e.g., such as a valve) in the cooling system 150. Other actuators may be coupled to various locations in the vehicle.

FIGS. 2-6 provide embodiments of a centrifugal pump 200 that may be included in an engine cooling system, such as the cooling system 150 of FIG. 1. For example, the centrifugal pump 200 may be one embodiment of the water pump 156 of FIG. 1. FIGS. 2-6 will be described collectively, with like components numbered the same and not reintroduced between figures. FIGS. 2-6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, and above/below may be relative to a vertical axis of the figures and used to describe positioning of elements of the figures relative to one another. As such, elements shown above other elements are positioned vertically above the other elements, in one example. Additionally, back/front and right/left may be relative to a horizontal axis of the figures, and elements shown as such are positioned behind/in front of or to the right/left the other elements, in one example. Further, reference axes 299 are included in each of FIGS. 2-6 in order to compare the view and relative orientations described below. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. FIGS. 2-6 are drawn approximately to scale, although other dimensions or relative dimensions may be used.

Turning first to FIG. 2, a cross-sectional view of the centrifugal pump 200 is shown. The centrifugal pump 200 includes both stationary components and components that are configured to rotate when the pump is operated, as will be elaborated below. The components that are configured to rotate share an axis of rotation 290 that is parallel with the x-axis of reference axes 299. The centrifugal pump 200 includes a stationary pump casing (e.g., pump housing) 202 and a stationary bearing casing (e.g., bearing housing) 204. The pump casing 202 houses an impeller 206 including a plurality of vanes 208, the rotation of which drives coolant fluid motion through the centrifugal pump. Specifically, the coolant enters the centrifugal pump 200 at an inlet 210, which may be coupled to the cooling system via a suction flange 212. Rotation of the impeller 206 results in the coolant being drawn in from the cooling system at the inlet 210. A volute 214 within the pump casing 202 receives the coolant pumped by the impeller 206, maintaining a velocity of the coolant and directing it to an outlet 216 of the centrifugal pump 200. The outlet 216 is coupled to a component receiving the coolant, such as a water jacket of an engine, via a discharge flange 218.

The impeller 206 is rotationally coupled to a shaft 220 that extends longitudinally through the centrifugal pump 200. As shown, the shaft 220 extends from the impeller 206, through the bearing casing 204, and to a drive attachment 236. The drive attachment 236 is external to the bearing casing 204 and the pump casing 202 and may be mechanically driven by the engine, for example. The rotation of the drive attachment 236 results in the rotation of the shaft 220, which rotates the impeller 206 to drive pumping action. Further, the shaft 220 is supported by one or more bearings housed within the bearing casing 204. In the example shown, the shaft 220 is supported by a radial bearing 232 and a thrust bearing 234.

A mechanical seal is provided around the shaft 220 to maintain the coolant in the pump casing 202 and prevent the coolant from flowing to the bearing casing 204. Specifically, the mechanical seal includes a stationary seal (or stationary ring) 228 and a rotating seal (or rotating ring) 230. The stationary seal 228 is fixedly coupled to a seal plate 226, which is fixedly coupled to at least one of the pump casing 202 and the bearing casing 204. The rotating seal 230 is affixed to the shaft 220. As such, the stationary seal 228 does not rotate, and the rotating seal 230 rotates around the axis of rotation 290 with a same rotational velocity as the shaft 220. The stationary seal 228 and the rotating seal 230 are positioned within a seal chamber 222 that is at least partially defined by a seal chamber housing 224. Components of the seal chamber 222 and the seal chamber housing 244 contained within an inset box 240 will be further described with respect to FIG. 3, which contains a magnified view of the inset box 240. Coolant may flow from a cooling jacket 238 of the centrifugal pump 200 to the seal chamber 222, as will be elaborated below. Coolant may be prevented from flowing past the seal plate 226 to the bearing casing 204 by the seal plate 226, the stationary seal 228, and the rotating seal 230.

Figure 3:
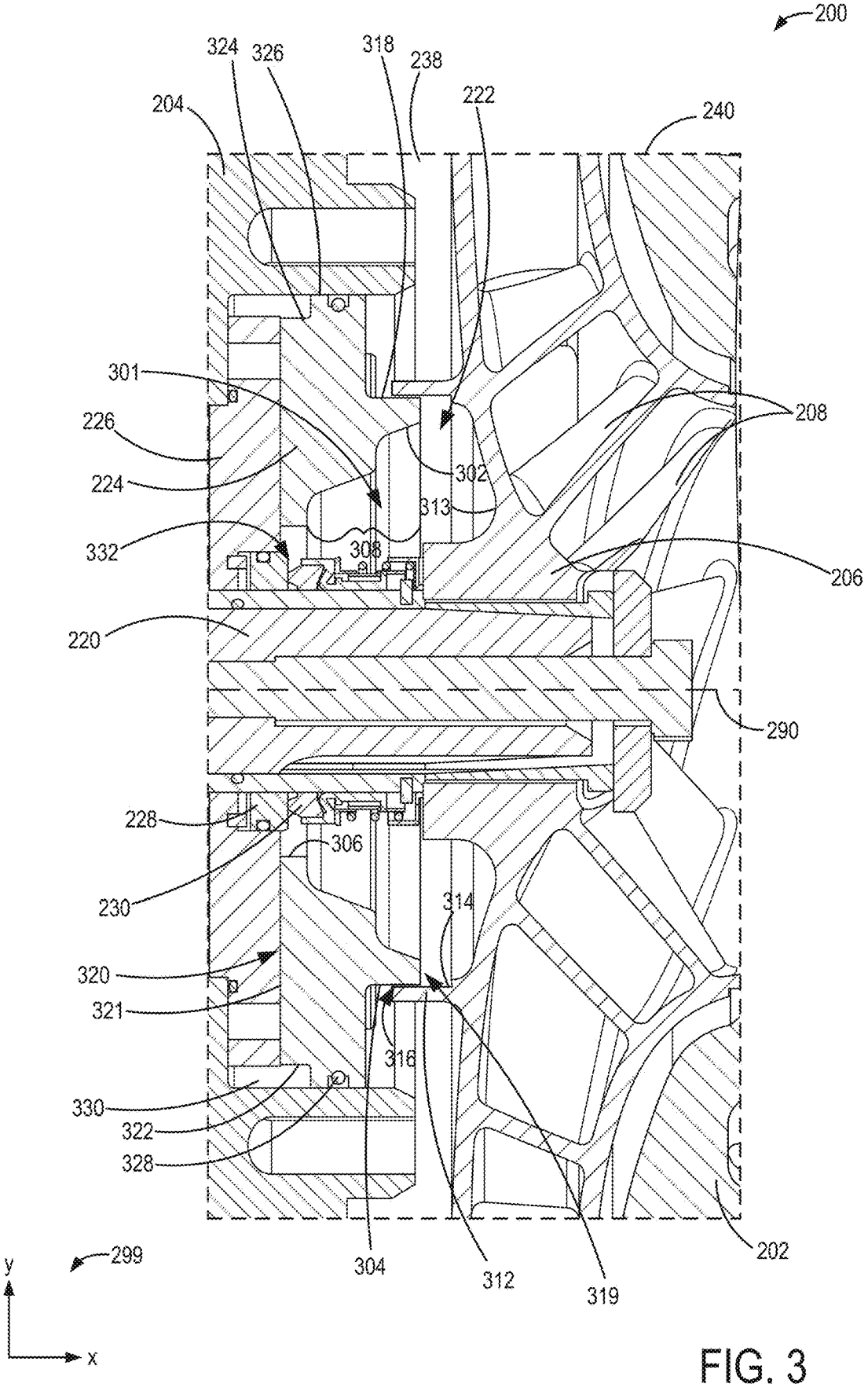
FIG. 3 shows a partial view of a seal chamber of the centrifugal pump of FIG. 2.

Continuing to FIG. 3, a detailed view of the seal chamber 222 of the centrifugal pump 200 within inset box 240 is shown. The view shown in FIG. 3 is rotated from the view shown in FIG. 2, as indicated by the reference axes 299, and is within the x-y plane, although the cross-sectional plane remains the same as the view shown in FIG. 2.

The seal chamber housing 224 includes a central cavity 301, an inner surface 302, an outer surface 304, a first end 319, and a second end 320. The central cavity 301 extends from an opening in a front surface of the seal chamber housing 224 at the first end 319 to an opening in a back surface 321 of the seal camber housing 224 at the second end 320 and partially defines a geometry of the seal chamber 222. The first end 319 is proximate to a back surface 313 of the impeller 206, and the back surface 321 is in face-sharing contact with the seal plate 226. Thus, the back surface 313 of the impeller 206 and the seal plate 226 further define the geometry of the seal chamber 222, and together, the seal chamber housing 224, the back surface of the impeller 206, and the seal plate 226 form and house the seal chamber 222.

The back surface 321 and the outer surface 304 are exterior (e.g., external) surfaces of the seal chamber housing 224, whereas the inner surface 302 is an interior surface of the seal chamber housing 224. The inner surface 302 defines a geometry of the central cavity 301 and includes a constant inner diameter region (e.g., portion) 306 and a variable inner diameter region (e.g., portion) 308. The constant inner diameter region 306 is positioned proximate to the second end 320 and has a smaller inner diameter than the variable inner diameter region 308. The variable inner diameter region 308 is positioned proximate to the first end 319, extending from the first end 319 to the constant inner diameter region 306. A length of the variable inner diameter region 308 is greater than a length of the constant inner diameter region 306 (e.g., in the x-direction of the reference axes 299). For example, the length of the variable inner diameter region 308 may be 2-5 times (e.g., four times) larger than the length of the constant inner diameter region 306. Further still, the inner diameter changes throughout the variable inner diameter region 308. As shown, the inner diameter increases in the variable inner diameter region 308 as a distance from the first end decreases (e.g., in the positive x-direction of the reference axes 299), giving the inner surface 302, and thus central cavity 301, a generally conical shape (e.g., a truncated cone, or conical frustum). Additionally, in the embodiment shown, the inner diameter of the variable inner diameter region 308 increases in a stepped (e.g., stepwise) fashion. Therefore, in the embodiment shown, the seal chamber 222 has a stepped conical frustum geometry.

The outer surface 304 of seal chamber housing 224 includes a first outer diameter region 318, a second outer diameter region 322, and a third outer diameter region 324. The first outer diameter region 318 has a smaller outer diameter than each of the second outer diameter region 322 and the third outer diameter region 324 and is positioned proximate to the first end 319. The second outer diameter region 322 has a smaller outer diameter than the third outer diameter region 324 and is positioned proximate to the second end 320. The third outer diameter region 324, positioned directly between the first outer diameter region 318 and the second outer diameter region 322, has a groove 326 with an o-ring 328 positioned therein. The third outer diameter region 324 and the o-ring 328 form a seal with the bearing casing 204 to separate the cooling jacket 238 from a secondary chamber 330.

The back surface 313 of the impeller 206 is positioned opposite the vanes 208 and includes a protrusion 312 that extends in the negative x-direction (with respect to reference axes 299) toward the first end 319 of the seal chamber housing 224. The back surface 313 of the impeller 206 and the protrusion 312 further define the seal chamber 222. In the example shown, the protrusion 312 is ring-shaped, forming a hollow cylinder. A portion of the protrusion 312 encircles (e.g., surrounds) a portion of the first outer diameter region 318 of the seal chamber housing 224 without being in direct contact with the seal chamber housing 224. For example, the portion of the protrusion 312 and the portion of first outer diameter region 318 of the seal chamber housing 224 share x-direction values but have different y-direction (e.g., height) and z-direction (e.g., depth) values.

The cylindrical protrusion 312 has an inner surface 314 with an inner diameter that is larger than an outer diameter of the outer surface 304 of the seal chamber housing 224 at the first outer diameter region 318, forming a gap (e.g., clearance) 316 between the inner surface 314 and the outer surface 304. The gap 316 between the inner diameter of the inner surface 314 and the outer diameter of the outer surface 304 at the first outer diameter region 318 may be less than 1 millimeter (mm), such as in a range from 0.1-0.8 mm. As one non-limiting example, the gap 316 may be 0.2 mm. The gap 316 fluidically couples the seal chamber 222 to the cooling jacket 238, enabling coolant to flow from the cooling jacket 238 into the seal chamber 222 via the gap 316. Debris particles that are smaller than the gap 316 may also flow into the seal chamber 222.

The shaft 220 extends through a center of the central cavity 301, with the stationary seal 228 and the rotating seal 230 positioned proximate to the second end 320 of the seal chamber housing 224, at least partially within the constant inner diameter region 306. A seal interface 332 between the stationary seal 228 and the rotating seal 230 comprises a small fluid-filled gap between the stationary seal 228 and the rotating seal 230. As the shaft 220 rotates the impeller 206, the shaft 220 also imparts centrifugal motion to the coolant in the seal chamber 222 so that the coolant circulates around the stationary seal 228 and the rotating seal 230, providing both cooling and lubrication to the seal interface 332. Because of the generally decreasing inner diameter of the seal chamber housing 224 from the first end 319 to the second end 320, and because the stationary seal 228 and the rotating seal 230 are positioned within the smallest inner diameter region (e.g., the constant inner diameter region 306), the centrifugal motion and rotational velocity of the coolant at the seal interface 332 is increased. As a result, increased cooling is provided to the seal interface 332, and debris particles are cleared from the seal interface 332 with increased efficiency. By increasing the centrifugal motion and the rotational velocity at the seal interface 332, the truncated stepped cone shape of central cavity 301 decreases degradation of the seal interface 332, and thus, decreases degradation of the centrifugal pump 200.

After circulating around the seal chamber 222, the coolant flows to the secondary chamber 330. The seal chamber housing 224 includes at least one flushing port (or passage), as will be elaborated below, to expel the coolant (and the debris particles) from the seal chamber 222 to the secondary chamber 330. The secondary chamber 330 may be periodically suctioned or cleaned to remove the debris particles from the secondary chamber 330, and therefore from the centrifugal pump 200 and the coolant circulated by the centrifugal pump 200.

Figure 4B:
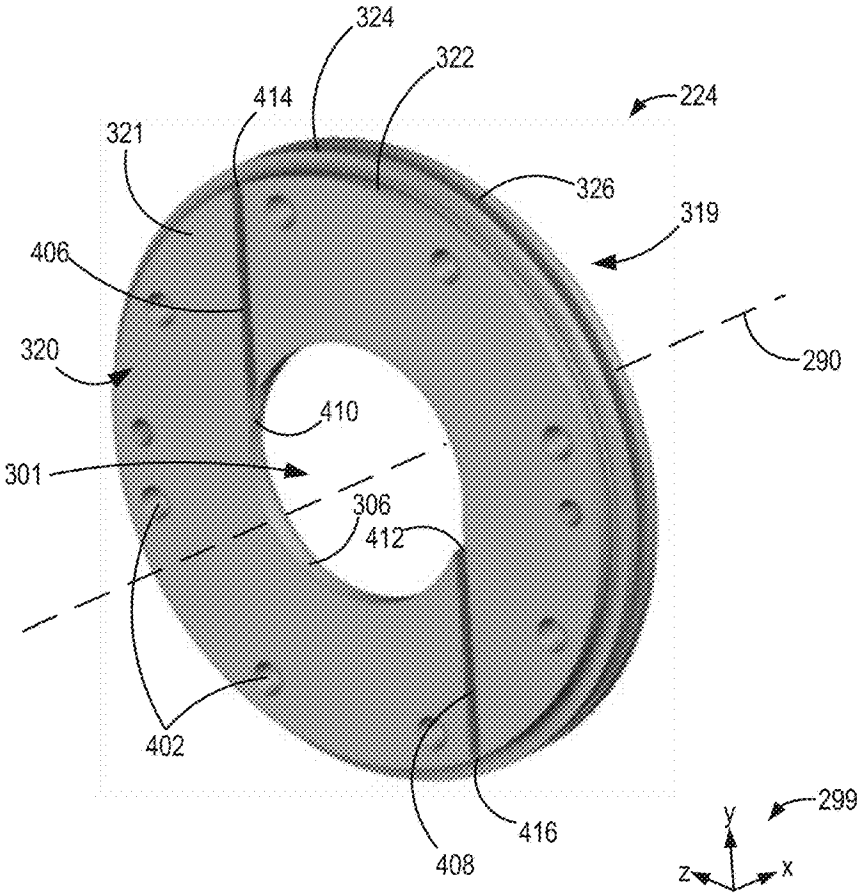
FIGS. 4A, 4B, and 4C show isolated views of a first embodiment of a seal chamber housing that may at least partially form the seal chamber of FIG. 3, the seal chamber housing including tangential flushing ports.
Figure 4A:
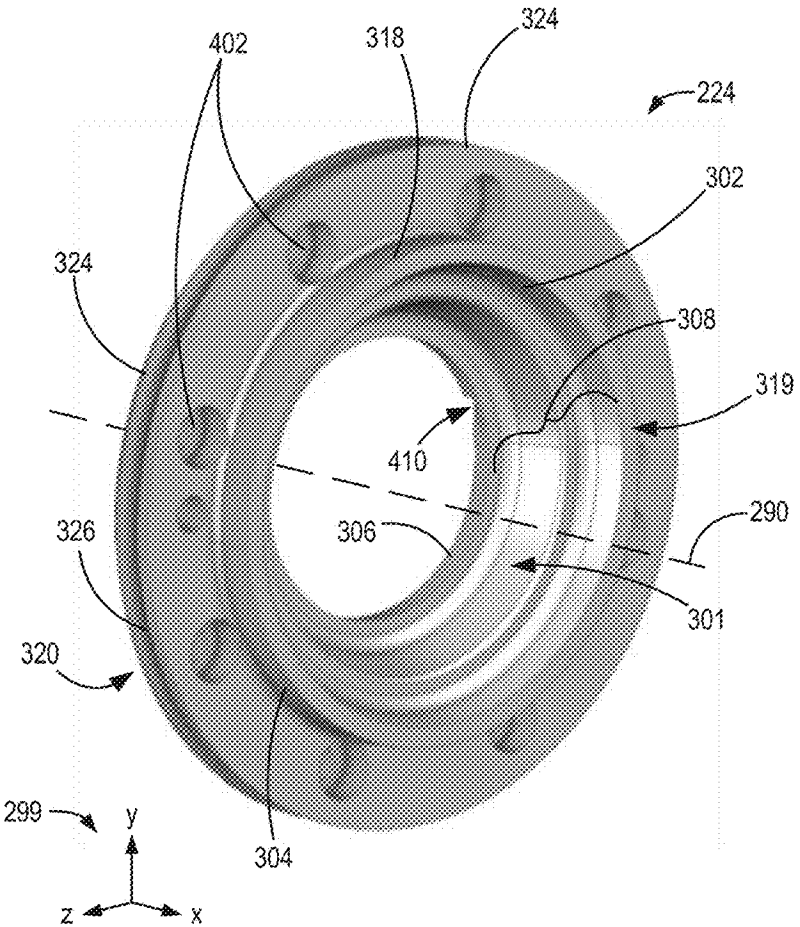
Figure 4C:
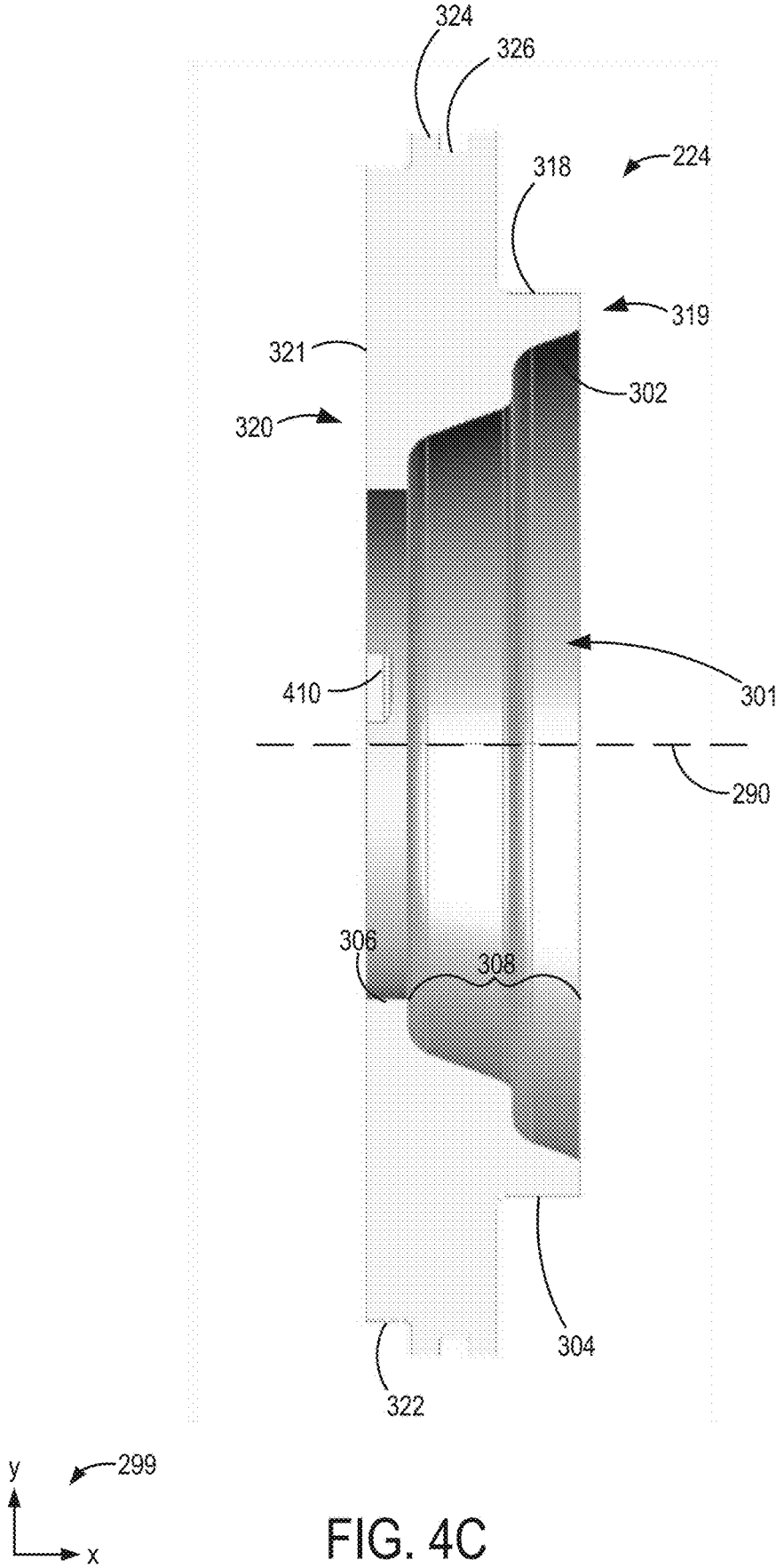

Turning now to FIGS. 4A-4C, isolated views of the seal chamber housing 224 are shown in order to particularly highlight the at least one flushing port. Specifically, FIG. 4A shows a perspective view from the first end 319 of the seal chamber housing 224, FIG. 4B shows a perspective view from the second end 320 of the seal chamber housing 224, and FIG. 4C shows a cross-sectional view of the seal chamber housing 224 in the x-y plane, as indicated by the reference axes 299. Further, the axis of rotation 290 of the centrifugal pump 200 is shown, which passes through the center of the central cavity 301 when seal chamber housing 224 is installed via a plurality of attachment holes 402. The plurality of attachment holes 402 enable the seal chamber housing 224 to be coupled to the seal plate 226 and the bearing casing 204 (not shown in FIGS. 4A-4C), as will be elaborated below with respect to FIG. 6.

Seal chamber housing 224 includes a first flushing port 406 and a second flushing port 408, as particularly shown in FIG. 4B. The first flushing port (or passage) 406 and the second flushing port (or passage) 408 are tangentially oriented from the central cavity 301. The first flushing port 406 and the second flushing port 408 form channels in the back surface 321 of the seal chamber housing 224, each extending from the inner surface 302 to the outer surface 304. Specifically, the first flushing port 406 includes a first flushing port inlet 410 at the inner surface 302 of the constant inner diameter region 306 and a first flushing port outlet 414 at the outer surface 304 of the second outer diameter region 322. Similarly, the second flushing port 408 includes a second flushing port inlet 412 at the inner surface of the constant inner diameter region 306 and a second flushing port outlet 416 at the outer surface 304 of the second outer diameter region 322. The first flushing port 406 is tangent to the constant inner diameter region 306 at a most negative z-direction value of the constant inner diameter region 306 and extends vertically in the positive y-direction without bending or curving. The second flushing port 408 is tangent to the constant inner diameter region 306 at a most positive z-direction value and extends vertically in the negative y-direction, opposite of the first flushing port 406, without bending or curving. However, in other embodiments, the flushing ports may curve helically between the inlet and the outlet, such as will be described with respect to FIG. 7. In the embodiment shown, the first flushing port 406 and the second flushing port 408 have a same, constant width (e.g., in the z-direction) and a same, constant depth (e.g., in the x-direction), although in other embodiments, the width of the first flushing port 406 and second flushing port 408 may increase from the inner surface 302 to the outer surface 304 to form a diffuser, as will be elaborated below with respect to FIG. 9.

The tangential orientation of the first flushing port 406 and the second flushing port 408 is such that the centrifugal motion of the coolant induced by the rotating shaft 220 (not shown in FIGS. 4A-4C) is enhanced by the flow out of (or into) the seal chamber 222 (see FIGS. 2 and 3) through the first flushing port 406 and the second flushing port 408. In this way, the rotational velocity of the coolant at the position closest to the seal interface 332 (see FIG. 3) is increased, resulting in increased centrifugal force on debris to clear the debris away from the seal interface.

The first flushing port 406 and the second flushing port 408 may be employed to draw the coolant out of the seal chamber 222 (not shown in FIGS. 4A-4C) to remove the undesirable debris, as described above. In an alternative embodiment, the first flushing port 406 and the second flushing port 408 may be configured for a positive flow into the seal chamber. Both configurations increase the centrifugal velocity of the coolant in the area near the stationary seal 228 (see FIGS. 2 and 3), which serves to drive debris away from the seal interface 332 (see FIGS. 2 and 3).

Continuing to FIG. 5, a backside view of the seal chamber housing 224 within the centrifugal pump 200 is provided to illustrate the arrangement of the flushing ports in the context of other components of the centrifugal pump 200. FIG. 5 shows a cross-sectional view of the centrifugal pump 200, with the cross-section of FIG. 5 perpendicular to the cross-sections of FIGS. 2, 3, and 4C. FIG. 5 shows the back surface 321 of the seal chamber housing 224 and the shaft 220 position within the central cavity 301. As such, the central cavity encircles the shaft 220, and the seal chamber housing 224 does not have direct contact with the shaft 220. Further, the pump casing 202 encloses the first end 319 of the seal chamber housing 224 (not visible in FIG. 5). As described above with reference to FIG. 4B, the first flushing port 406 and the second flushing port 408 are tangentially oriented from the constant inner diameter region 306, and thus, the first flushing port 406 and the second flushing port 408 may draw off (or supply) coolant from around shaft 220 and the seals positioned therearound (e.g., stationary seal 228 and rotating seal 230 shown in FIGS. 2 and 3) from the constant inner diameter region 306.

In order to further show the arrangement of the flushing port(s) in the context of other components of the centrifugal pump 200, FIG. 6 shows a different partial cross-sectional view of the seal chamber 222 and the seal chamber housing 224 than FIG. 3. Although FIG. 6 is also in the x-y plane, the cross-section of FIG. 6 is further into the page (e.g., in the negative z-direction with respect to reference axes 299) than the cross-section of FIG. 3. In particular, the cross-sectional plane of FIG. 6 bisects first flushing port 406. Further, for simplicity, not all of the components introduced in FIGS. 2-4C are referenced in FIG. 6, although it may be understood that those components are present in the same orientations described above.

FIG. 6 shows a fastener 602 inserted within one of the plurality of attachment holes 402. The fastener 602 extends through the attachment hole 402, through a corresponding attachment hole in the seal plate 226, and to a corresponding attachment hole in the bearing casing 204. Thus, the seal chamber housing 224 is coupled to the seal plate 226 and the bearing casing 204, with the seal plate 226 positioned between the seal chamber housing 224 and the bearing casing 204 and in direct, face-sharing contact with each of the seal chamber housing 224 and the bearing casing 204. Although only one fastener 602 is shown in the cross-sectional view of FIG. 6, it may be understood that each of the plurality of attachment holes 402 includes a fastener 602 inserted therein when the seal chamber housing 224 is installed in the centrifugal pump 200. As such, the seal chamber housing 224 held in place by the fasteners 602 within the plurality of attachment holes 402 in a position that is centered on the axis of rotation 290 of the centrifugal pump 200.

As shown in FIG. 6, a front surface of the seal plate 226 is in direct face-sharing contact with the back surface 321 of the seal chamber housing 224. As such, a back side of the first flushing port 406 is sealed by the seal plate 226, and the first flushing port 406 forms a channel through the seal chamber housing 224 between the seal plate 226 and the seal chamber housing 224, from the first flushing port inlet 410 at the constant inner diameter region 306 to the first flushing port outlet 414 at the third outer diameter region 324. As a result, as the impeller 206 turns, fluid (e.g., coolant) may flow from the cooling jacket 238, past the gap 316 between the outer surface 304 of the seal chamber housing 224 and the inner surface 314 of the protrusion 312 extending from the impeller 206, and into the seal chamber 222, and coolant may flow from the seal chamber 222 to the secondary chamber 330 external to the seal chamber housing 224 via the first flushing port 406 (and via the second flushing port 408, which is not visible in the cross-section shown). Thus, the flushing ports directly fluidically couple the seal chamber 222 to the secondary chamber 330 and directly fluidically couple the interior of the seal chamber housing 224 (e.g., the central cavity 301) to the exterior of the seal chamber housing 224.

However, other flushing passage configurations and arrangements are also possible that increase fluid movement around the seal. Next, FIG. 7 schematically depicts a back view of a seal chamber housing 700. Reference axes 799 are provided, which have the same relative orientation as the reference axes 299 of FIGS. 2-6 in order to orient the seal chamber housing 700 to the seal chamber housing 224 shown in FIGS. 2-6. It may be understood that the seal chamber housing 700 may include all or some of the components described above with reference to seal chamber housing 224 of FIGS. 2-6 and may be similarly coupled in the centrifugal pump 200. Thus, the seal chamber housing 700 may differ from the seal chamber housing 224 only in the flushing passage configuration described below, at least in some examples.

The seal chamber housing 700 includes a helical flushing passage 702, which forms a channel in a back surface 704 of the seal chamber housing 700. The helical flushing passage 702 includes a circular portion 708, a first passage segment 710, and a second passage segment 712. The first passage segment 710 directly fluidically couples the circular portion 708 to an exterior of the seal chamber housing 700 via a first flushing passage outlet 714, and the second passage segment 712 directly fluidically couples the circular portion 708 to the exterior of the seal chamber housing 700 via a second flushing passage outlet 716. One or more flushing passage inlets (not shown) directly fluidically couple the circular portion 708 to a central cavity 706 in the interior of the seal chamber housing 700. As described above with respect to FIGS. 2 and 3, the seal chamber housing 700 may partially define a seal chamber (e.g., seal chamber 222) when the seal chamber housing 700 is installed in the centrifugal pump, with a seal interface positioned within the central cavity 706 (e.g., seal interface 332). Thus, the helical flushing passage 702 may flow coolant out of the seal chamber formed within the central cavity 706. Alternatively, the helical flushing passage 702 may flow coolant into the central cavity 706.

Together, the first passage segment 710, the second passage segment 712, and the circular portion 708 are arranged helically around the central cavity 706. Compared with the tangentially oriented flushing ports described with respect to FIGS. 4A-6, the helical flushing passage 702 may reduce a disturbance of an angular momentum of the coolant, which reduces an occurrence of coolant recirculation and eddies near an interface of helical flushing passage 702 with the seal chamber, thus maximizing a velocity of the coolant near the seal interface. By further increasing the velocity of the coolant near the seal interface, debris removal and cooling at the seal interface may be further increased.

FIG. 8 schematically depicts a back view of a seal chamber housing 800. Reference axes 899 are provided, which have the same relative orientation as the reference axes 299 of FIGS. 2-6 in order to orient the seal chamber housing 800 to the seal chamber housing 224 of FIGS. 2-6. It may be understood that the seal chamber housing 800 may include all or some of the components described above with reference to seal chamber housing 224 of FIGS. 2-6 and may be similarly coupled in the centrifugal pump 200. Thus, the seal chamber housing 800 may differ from the seal chamber housing 224 only in the flushing passage configuration described below, at least in some examples.

The seal chamber housing 800 includes a volute-shaped flushing passage 802, which forms a channel in a back surface 804 of the seal chamber housing 800. The volute-shaped flushing passage 802 includes a volute portion 808 that includes a volute-shaped region, a first passage segment 810, and a second passage segment 812. The first passage segment 810 directly fluidically couples the volute portion 808 to an exterior of the seal chamber housing 800 via a first flushing passage outlet 814, and the second passage segment 812 directly fluidically couples the volute portion 808 to the exterior of the seal chamber housing 800 via a second flushing passage outlet 816. One or more flushing passage inlets (not shown) directly fluidically couple the volute portion 808 to a central cavity 806 in the interior of the seal chamber housing 800. As described above with respect to FIGS. 2 and 3, the seal chamber housing 800 may partially define a seal chamber (e.g., seal chamber 222) when the seal chamber housing 800 is installed in the centrifugal pump, with a seal interface positioned within the central cavity 806 (e.g., seal interface 332) at a constant diameter region of the seal chamber housing 800 (e.g., constant inner diameter region 306). Thus, the volute-shaped flushing passage 802 may flow coolant out of the seal chamber within the central cavity 806. Alternatively, the volute-shaped flushing passage 802 may flow coolant into the central cavity 806.

The volute portion 808 is positioned around the central cavity 806 at the constant diameter region, such as encircling the constant diameter region. By including the volute shape around the seal interface, a uniform deceleration passage is created around the seal, which helps in collecting the debris and ensuring its smooth exit from the cavity. Further, debris is not reinjected close to the seal interface. In one example of a volute shape, a geometry of the volute portion 808 may be such that a ratio of area and radius is constant, meaning that the area increases with radius circumferentially. The geometry may serve as a cavity to collect the debris around 360 degrees of the volute-shaped flushing passage 802 and purge it out through the first flushing passage outlet 814 and the second flushing passage outlet 816. As a result, increased debris capture and clearance from the seal chamber may be achieved.

FIG. 9 schematically depicts a back view of a seal chamber housing 900. Reference axes 999 are provided, which have the same relative orientation as the reference axes 299 of FIGS. 2-6 in order to orient the seal chamber housing 900 to the seal chamber housing 224 of FIGS. 2-6. It may be understood that the seal chamber housing 900 may include all or some of the components described above with reference to seal chamber housing 224 of FIGS. 2-6 and may be similarly coupled in the centrifugal pump 200. Thus, the seal chamber housing 900 may differ from the seal chamber housing 224 only in the flushing passage configuration described below, at least in some examples.

The seal chamber housing 900 includes a flushing passage diffuser 902, which forms a plurality of channels in a back surface 904 of the seal chamber housing 900. The flushing passage diffuser 902 includes a first circular portion 908, a second circular portion 910, a first passage 912, a second passage 914, a third passage 916, a fourth passage 918, a fifth passage 920, a sixth passage 922, a seventh passage 924, and an eighth passage 926. Note that although eight passages are shown, in other embodiments, the flushing passage diffuser 902 may include more or fewer than eight passages. Each of the first passage 912, the second passage 914, the third passage 916, the fourth passage 918, the fifth passage 920, the sixth passage 922, the seventh passage 924, and the eighth passage 926 directly fluidically couples the first circular portion 907 and the second circular portion 910. Further, each of the first passage 912, the second passage 914, the third passage 916, the fourth passage 918, the fifth passage 920, the sixth passage 922, the seventh passage 924, and the eighth passage 926 has a tapered width that increases from a junction with the first circular portion 908 toward a junction with the second circular portion 910, which reduces a coolant speed as it flows from the first circular portion 908 to the second circular portion 910.

In the example shown, the second circular portion 910 is directly fluidically coupled to the exterior of the seal chamber housing 900. One or more flushing passage inlets (not shown) directly fluidically couple the first circular portion 908 to a central cavity 906 in the interior of the seal chamber housing 900. As described above with respect to FIGS. 2 and 3, the seal chamber housing 900 may partially define a seal chamber (e.g., seal chamber 222) when the seal chamber housing 900 is installed in the centrifugal pump, with a seal interface positioned within the central cavity 906 (e.g., seal interface 332). Thus, the flushing passage diffuser 902 may flow coolant out of the seal chamber within the central cavity 906. Alternatively, the flushing passage diffuser 902 may flow coolant into the central cavity 906.

In an alternative embodiment, each of the first passage 912, the second passage 914, the third passage 916, the fourth passage 918, the fifth passage 920, the sixth passage 922, the seventh passage 924, and the eighth passage 926 may include an inlet at the central cavity 906 (e.g., at an inner surface of the seal chamber housing 900) and an outlet at an outer surface of the seal chamber housing 900. As such, the first circular portion 908 and the second circular portion 910 may not be included, with each passage directly fluidically coupling to the central cavity 906 to the exterior of the seal chamber housing 900.

By providing multiple seal chamber exits via the flushing passage diffuser 902, flow field disturbances near the seal interface may be further minimized. As one example, the tapered geometry of each passage may promote coolant flow out of the seal chamber. Further, in some embodiments, the diffuser shown in FIG. 9 may be combined with the volute-shaped flushing passage 802 of FIG. 8 to further collect debris and minimize flow field disturbances as the debris is ejected from the seal chamber. For example, the geometry of the volute may define a diffusing passage, and as such, the diffuser may be integrated within the volute.

FIG. 10 schematically depicts a back view of a seal chamber housing 1000. Reference axes 1099 are provided, which have the same relative orientation as the reference axes 299 of FIGS. 2-6 in order to orient the seal chamber housing 1000 to the seal chamber housing 224 of FIGS. 2-6. It may be understood that the seal chamber housing 1000 may include all or some of the components described above with reference to seal chamber housing 224 of FIGS. 2-6 and may be similarly coupled in the centrifugal pump 200. Thus, the seal chamber housing 1000 may differ from the seal chamber housing 224 only in the flushing passage configuration described below, at least in some examples.

The seal chamber housing 1000 includes a flushing passage 1002, which forms a plurality of channels in a back surface 1004 of the seal chamber housing 1000. The flushing passage 1002 includes a circular portion 1008 that surrounds a central cavity 1006 of the seal chamber housing 1000. The flushing passage 1002 further includes a first flushing port 1010 that extends from a first dead chamber 1018 and a second flushing port 1012 that extends from a second dead chamber 1020. The first flushing port 1010 fluidically couples the circular portion 1008 to an exterior of the seal chamber housing 1000 via the first dead chamber 1018 and a first flushing passage outlet 1014, and the second flushing port 1012 directly fluidically couples the circular portion 1008 to the exterior of the seal chamber housing 1000 via a second flushing passage outlet 1016 and the second dead chamber 1020. As described above with respect to FIGS. 2 and 3, the seal chamber housing 1000 may partially define a seal chamber (e.g., seal chamber 222) when the seal chamber housing 1000 is installed in the centrifugal pump, with a seal interface positioned within the central cavity 1006 (e.g., seal interface 332). Thus, the flushing passage 1002 may flow coolant out of the seal chamber formed within the central cavity 1006. Alternatively, the flushing passage 1002 may flow coolant into the central cavity 1006.

The first dead chamber 1018 and the second dead chamber 1020 are positioned and shaped to accumulate debris expelled from the seal chamber. For example, the first dead chamber 1018 and the second dead chamber 1020 may each include a varying, irregular geometry that generally has a greater width than a width of each of the first flushing port 1010 and the second flushing port 1012. Due to the wider, irregularly shaped dead chambers, the debris may decelerate in the dead chambers 1018 and 1020. As one example, the dead chambers 1018 and 1020 may include increased surface area due to their irregular shape, increasing the area on which the debris may accumulate and preventing it from returning to the seal chamber to accumulate on the seal interface. The seal chamber housing 1000 may be periodically removed to clean the dead chambers 1018 and 1020, such as according to a pre-determined maintenance schedule. Although the seal chamber housing 1000 includes two dead chambers, in other embodiments, a different number of dead chambers may be included. For example, more or fewer than two dead chambers may be included in the seal chamber housing 1000.

Next, FIG. 11 provides a method 1100 for flowing coolant through a centrifugal pump, such as the centrifugal pump 200 introduced in FIG. 2. The centrifugal pump may be included in a cooling system of a vehicle, such as the cooling system 150 shown in FIG. 1. At least portions of method 1100 may be executed by a controller, such as the controller 110 shown in FIG. 1, based on instructions stored in non-transitory memory.

At 1102, method 1100 includes suctioning coolant into the centrifugal pump by rotating an impeller of the centrifugal pump. As described above with respect to FIG. 2, the impeller is housed within a casing of the centrifugal pump and driven by a shaft that couples the impeller to a drive attachment. Thus, the impeller is rotationally coupled to the drive attachment via the shaft. In some embodiments, the drive attachment is rotationally coupled to an engine of the vehicle, and the engine mechanically drives the rotation of the drive attachment, and thus the shaft and the impeller. In other embodiments, the drive attachment is coupled to an electric motor, and the controller actuates the electric motor (e.g., by supplying electric power to the electric motor) to drive the rotation of the impeller. The rotation of the impeller (which includes a plurality of impeller vanes) drives coolant fluid motion through the centrifugal pump. For example, cold coolant may be drawn in through an inlet coupled to the cooling system, and a volute may receive the coolant drawn in through the inlet. From the volute, the coolant may be directed to an outlet of the centrifugal pump. The outlet may be coupled to a water jacket of the engine, which may receive the coolant pumped from the centrifugal pump.

At 1104, method 1100 includes flowing the coolant into a seal chamber of the centrifugal pump. For example, at least a portion of the coolant may flow into a cooling jacket that is fluidically coupled to the seal chamber (e.g., seal chamber 222 introduced in FIG. 2) via a small clearance between a bottom of the impeller and a seal chamber housing (e.g., seal chamber housing 224 introduced in FIG. 2). As described above with respect to FIG. 3, a back surface of the impeller, a seal plate, and the seal chamber housing may define the seal chamber, with the shaft passing through a center of the seal chamber. Further, the coolant may include debris, which may include particulates fine enough to pass through the small clearance.

At 1106, method 1100 includes circulating the coolant around a seal interface positioned within the seal chamber via centrifugal motion induced by the rotating shaft. The seal interface is a mating surface formed between a rotating seal fixed to the shaft (e.g., rotating seal 230 of FIGS. 2 and 3) and a stationary seal that does not rotate with the shaft (e.g., stationary seal 228 of FIGS. 2 and 3). As described above with particular reference to FIG. 3, a geometry of the seal chamber may be at least partially defined by the seal chamber housing. For example, the seal chamber may be generally cone-shaped or stepped cone-shaped, with a diameter of the seal chamber decreasing from a first end proximate to the impeller and the cooling jacket to a second end proximate to the seal interface. The conical or stepped conical shape of the seal chamber may encourage the flow of particulate debris in the coolant away from the seal interface. In particular, the stepped conical geometry may reduce the occurrence of the debris returning to the smaller clearance area near the seal interface.

At 1108, method 1100 includes flowing the coolant and debris out of the seal chamber via one or more flushing ports. The one or more flushing ports may directly fluidically couple the seal chamber to a secondary chamber external to the seal chamber housing. As described above with particular reference to FIGS. 4A-6, each flushing port may form a channel within the seal chamber housing and include an inlet positioned at the second end of the seal chamber, proximate to the seal interface, that draws the coolant and the debris contained therein away from the seal interface and to the secondary chamber. The one or more flushing ports may include tangentially oriented flushing ports, such as those described with reference to FIGS. 4A-6, a helical flushing passage (e.g., the helical flushing passage 702 of FIG. 7), a flushing passage including a volute (e.g., the volute-shaped flushing passage 802 of FIG. 8), a flushing passage including a diffuser (e.g., the flushing passage diffuser 902 of FIG. 9), and/or one or more dead chambers for accumulating the debris (e.g., the first dead chamber 1018 and the second dead chamber 1020 of FIG. 10). By including the inlet to the one or more flushing ports at the smaller diameter end of the seal chamber, a velocity of the coolant at the seal interface may be increased (versus locating the inlet at another location or not including the one or more flushing passages), thereby increasing an amount of debris removed from the seal interface as well as increasing cooling provided to the seal interface. Method 1100 may then end.

In this way, debris from coolant may be efficiently removed from a centrifugal pump, thereby reducing seal degradation. Further, by increasing centrifugal motion around the seal, heat-related seal degradation may be reduced via increased cooling. By decreasing seal degradation, coolant leakage may be decreased, thereby decreasing pump degradation and repairs. Overall, a lifetime of the centrifugal pump may be increased with decreased maintenance costs and downtime.

The technical effect of including a substantially conical seal chamber housing having flushing ports arranged to increase centrifugal motion around a seal interface of a centrifugal pump is that degradation of the centrifugal pump is decreased.

In one embodiment, a seal chamber housing for a centrifugal pump comprises: a central cavity internal to the seal chamber housing, the central cavity having a greater diameter at a first end of the seal chamber housing and a smaller diameter at a second end of the seal chamber housing; and at least one flushing passage at the second end of the seal chamber housing, the at least one flushing passage configured to directly fluidically couple the central cavity to an exterior of the seal chamber housing. In a first example of the seal chamber housing, the central cavity is defined by an inner surface of the seal chamber housing, the inner surface having a constant diameter region proximate to the second end of the seal chamber housing and a variable diameter region extending between the constant diameter region and the first end of the seal chamber housing. In a second example of the seal chamber housing, which optionally includes the first example, an inner diameter of the variable diameter region increases as a distance from the first end of the seal chamber housing decreases, and a length of the variable diameter region is greater than a length of the constant diameter region. In a third example of the seal chamber housing, which optionally includes one or both of the first example and the second example, the at least one flushing passage forms a channel in a back exterior surface of the seal chamber housing at the second end, the channel extending from an inlet at the constant diameter region to an outlet at an outer surface of the seal chamber housing. In a fourth example of the seal chamber housing, which optionally includes any or all of the first through third examples, the at least one flushing passage is tangentially oriented from the constant diameter region. In a fifth example of the seal chamber housing, which optionally includes any or all of the first through fourth examples, the at least one flushing passage is arranged helically around the constant diameter region. In a sixth example of the seal chamber housing, which optionally includes any or all of the first through fifth examples, the at least one flushing passage includes a volute-shaped region encircling the constant diameter region. In a seventh example of the seal chamber housing, which optionally includes any or all of the first through sixth examples, the at least one flushing passage includes a diffuser between the inlet at the constant diameter region and the outlet at the outer surface of the seal chamber housing. In an eighth example of the seal chamber housing, which optionally includes any or all of the first through seventh examples, the at least one flushing passage includes a dead chamber positioned between the inlet at the constant diameter region and the outlet at the outer surface of the seal chamber housing, the dead chamber including a greater width than each of the inlet and the outlet.

In another embodiment, a system for a seal chamber of a centrifugal pump comprises: a seal chamber housing including a central cavity extending from a first end of the seal chamber housing to a second end of the seal chamber housing, the central cavity defined by an inner surface having a greater inner diameter at the first end and a smaller inner diameter at the second end, and at least one flushing passage in an external surface of the second end of the seal chamber housing; a seal plate in face-sharing contact with the external surface of the second end of the seal chamber housing; and a bottom surface of an impeller of the centrifugal pump. In a first example of the system, the inner surface includes a constant diameter region at the second end and a variable diameter region that extends from the constant diameter region to the first end. In a second example of the system, which optionally includes the first example, the inner surface at the variable diameter region includes a stepped conical geometry. In a third example of the system, which optionally includes one or both of the first example and the second example, the at least one flushing passage includes an inlet in the constant diameter region of the inner surface of the seal chamber housing and an outlet at an outer surface of the seal chamber housing at the second end, and the at least one flushing passage forms a channel between the seal chamber housing and the seal plate. In a fourth example of the system, which optionally includes any or all of the first through third examples, the at least one flushing passage has a constant width and extends tangentially from the constant diameter region to the outer surface. In a fifth example of the system, which optionally includes any or all of the first through fourth examples, the at least one flushing passage includes a chamber between the inlet and the outlet, and the chamber has a greater width than each of the inlet and the outlet. In a sixth example of the system, which optionally includes any or all of the first through fifth examples, a width of the at least one flushing passage increases from the inlet to the outlet.

In another embodiment, a method for a centrifugal pump comprises: suctioning coolant into the centrifugal pump by rotating an impeller housed within a casing of the centrifugal pump; flowing the coolant into a seal chamber of the centrifugal pump; circulating the coolant around a seal interface positioned within the seal chamber; and flowing the coolant out of the seal chamber via one or more flushing ports. In a first example of the method, rotating the impeller housed within the casing of the centrifugal pump includes rotating the impeller via a shaft extending between a drive attachment external to the casing and the impeller. In a second example of the method, which optionally includes the first example, the shaft extends through a center of the seal chamber and the seal interface is positioned between a rotating seal affixed to the shaft and a stationary seal affixed to a housing of the seal chamber, and circulating the coolant around the seal interface includes imparting centrifugal motion to the coolant in the seal chamber by rotating the shaft. In a third example of the method, which optionally includes one or both of the first example and the second example, the one or more flushing ports are positioned proximate to the seal interface, and flowing the coolant out of the seal chamber via the one or more flushing ports includes drawing the coolant out of the seal chamber to a secondary chamber directly fluidically coupled to the seal chamber via the one or more flushing ports.

As used herein, an element or step recited in the singular and proceeded with the word "a" or "an" should be understood as not excluding plural of said elements or steps, unless such exclusion is explicitly stated. Furthermore, references to "one embodiment" of the invention do not exclude the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A seal chamber housing for a centrifugal pump, the seal chamber housing comprising:

a central cavity internal to the seal chamber housing, the central cavity having a greater diameter at a first end of the seal chamber housing and a smaller diameter at a second end of the seal chamber housing; and at least one flushing passage at the second end of the seal chamber housing, the at least one flushing passage configured to directly fluidically couple the central cavity to an exterior of the seal chamber housing, wherein the at least one flushing passage forms a channel in a back external surface of the seal chamber housing at the second end, the back external surface of the seal chamber housing in face-sharing contact with a seal plate.

2. The seal chamber housing of claim 1, wherein the central cavity is defined by an inner surface of the seal chamber housing, the inner surface having a constant diameter region proximate to the second end of the seal chamber housing and a variable diameter region extending between the constant diameter region and the first end of the seal chamber housing.

3. The seal chamber housing of claim 2, wherein an inner diameter of the variable diameter region increases as a distance from the first end of the seal chamber housing decreases, and a length of the variable diameter region is greater than a length of the constant diameter region.

4. The seal chamber housing of claim 2, wherein the channel extends from an inlet at the constant diameter region to an outlet at a radially outer surface of the seal chamber housing.

5. The seal chamber housing of claim 4, wherein the at least one flushing passage is tangentially oriented from the constant diameter region.

6. The seal chamber housing of claim 4, wherein the at least one flushing passage is arranged helically around the constant diameter region.

7. The seal chamber housing of claim 4, wherein the at least one flushing passage includes a volute-shaped region encircling the constant diameter region.

8. The seal chamber housing of claim 4, wherein the at least one flushing passage includes a diffuser between the inlet at the constant diameter region and the outlet at the radially outer surface of the seal chamber housing.

9. The seal chamber housing of claim 4, wherein the at least one flushing passage includes a dead chamber positioned between the inlet at the constant diameter region and the outlet at the radially outer surface of the seal chamber housing, the dead chamber including a greater width than each of the inlet and the outlet.

10. A system for a seal chamber housing of a centrifugal pump, the system comprising:

a seal chamber housing including a central cavity extending from a first end of the seal chamber housing to a second end of the seal chamber housing, the central cavity defined by an inner surface having a greater inner diameter at the first end and a smaller inner diameter at the second end, and at least one flushing passage in a back external surface of the seal chamber housing at the second end;

a seal plate in face-sharing contact with the back external surface of the seal chamber housing; and a bottom surface of an impeller of the centrifugal pump.

11. The system of claim 10, wherein the inner surface includes a constant diameter region at the second end and a variable diameter region that extends from the constant diameter region to the first end.

12. The system of claim 11, wherein the inner surface at the variable diameter region includes a stepped conical geometry.

13. The system of claim 11, wherein the at least one flushing passage includes an inlet in the constant diameter region of the inner surface of the seal chamber housing and an outlet at a radially outer surface of the seal chamber housing at the second end, and the at least one flushing passage forms a channel between the seal chamber housing and the seal plate.

14. The system of claim 13, wherein the at least one flushing passage has a constant width and extends from the constant diameter region to the radially outer surface.

15. The system of claim 13, wherein the at least one flushing passage includes a chamber between the inlet and the outlet, and the chamber has a greater width than each of the inlet and the outlet.

16. The system of claim 13, wherein a width of the at least one flushing passage increases from the inlet to the outlet.

17. A method for a centrifugal pump, comprising:

suctioning a coolant into the centrifugal pump by rotating an impeller housed within a casing of the centrifugal pump;

flowing the coolant into a seal chamber of the centrifugal pump;

circulating the coolant around a seal interface positioned within the seal chamber, the seal interface positioned at a reduced inner diameter region of the seal chamber; and flowing the coolant out of the seal chamber via one or more flushing ports, wherein the one or more flushing ports are positioned proximate to the seal interface and form one or more respective channels in a back external surface of a seal chamber housing, and wherein the back external surface of the seal chamber housing is in face-sharing contact with a seal plate.

18. The method of claim 17, wherein rotating the impeller housed within the casing of the centrifugal pump includes rotating the impeller via a shaft extending between a drive attachment external to the casing and the impeller.

19. The method of claim 18, wherein the shaft extends through a center of the seal chamber and the seal interface is positioned between a rotating seal affixed to the shaft and a stationary seal affixed to a housing of the seal chamber, and circulating the coolant around the seal interface includes imparting centrifugal motion to the coolant in the seal chamber by rotating the shaft.

20. The method of claim 17, wherein flowing the coolant out of the seal chamber via the one or more flushing ports includes drawing the coolant out of the seal chamber to a secondary chamber directly fluidically coupled to the seal chamber via the one or more flushing ports.

* * * * *